US005097542A

United States Patent [19]

Roesler

[11] Patent Number: 5,097,542

[45] Date of Patent: Mar. 24, 1992

[54] BATHING CHAIR

[76] Inventor: Gary M. Roesler, P.O. Box 623, Grafton, N. Dak. 58237

[21] Appl. No.: 523,993

[22] Filed: May 16, 1990

[51] Int. Cl.[5] ..... A47K 3/12

[52] U.S. Cl. ..... 4/579

[58] Field of Search ..... 4/560, 561, 564, 565, 4/566, 571, 573, 578, 579, 604; 297/340, 346, 349

[56] References Cited

U.S. PATENT DOCUMENTS

| | | | |
|---|---|---|---|
| 657,640 | 9/1900 | Brown | 4/579 |
| 1,805,297 | 5/1931 | Sadusky et al. | 4/579 |
| 2,045,110 | 6/1936 | Spiess | 4/562 |
| 2,142,434 | 1/1939 | Bentz | 4/579 |
| 2,237,076 | 4/1941 | Kenney et al. | 4/579 |
| 3,022,518 | 2/1962 | Hayden | 4/562 |
| 3,103,384 | 9/1963 | Zivi | 4/564 X |
| 3,203,008 | 8/1965 | Murcott | 4/561 |
| 3,256,036 | 6/1966 | Nolan | 4/564 X |
| 3,435,466 | 4/1969 | Cheney | 4/578 X |
| 3,528,111 | 9/1970 | Chou | 4/579 X |
| 3,624,666 | 11/1971 | Higgins, Sr. | 4/562 |
| 3,718,365 | 2/1973 | Gibson | 297/349 |
| 4,091,479 | 5/1978 | Hancock | 4/578 X |
| 4,122,571 | 10/1978 | Moeser | 297/349 X |
| 4,150,445 | 4/1979 | Bailey | 4/567 X |
| 4,168,549 | 9/1979 | Davies | 4/578 |
| 4,373,221 | 2/1983 | Wilson | 4/559 |
| 4,518,139 | 5/1985 | Barfell | 297/349 X |
| 4,655,632 | 4/1987 | Smith | 297/349 X |
| 4,837,871 | 6/1989 | Wheeler | 4/546 |
| 4,844,543 | 7/1989 | Ochiai | 297/349 |
| 4,941,218 | 7/1990 | McCartney | 4/579 |
| 5,010,606 | 4/1991 | Bernstein et al. | 4/579 X |

FOREIGN PATENT DOCUMENTS

| | | |
|---|---|---|
| 2520998 | 3/1983 | France . |
| 2119241 | 11/1983 | United Kingdom . |

*Primary Examiner*—Henry J. Recla
*Assistant Examiner*—Robert M. Fetsuga
*Attorney, Agent, or Firm*—Kinney & Lange

[57] ABSTRACT

A chair that will fit inside of a bath tub or shower stall is supported firmly on suction cup held legs, defining a platform. A seat having a seat portion and a folding backrest is mounted on the legs for pivoting movement about a vertical axis. The pivoting movement is capable of being restrained or controlled at least a desired number of positions, or if a break is used at any infinite number of positions so that a person seated on the seat may shower and rotate for gaining access of the shower to all surfaces of the skin. Because of the suction cup retainers on the legs, the unit is safe and simple to use and aids for elderly and handicapped in particular in showering.

5 Claims, 4 Drawing Sheets

BATHING CHAIR

BACKGROUND OF THE INVENTION

The present invention relates to a shower chair that is designed to be easily used by persons that are restricted in movement and which chair can be placed inside a shower stall or a bath tub, held in place, to permit showering while seated.

The prior art has shown various chairs that have been available for shower stalls, but none that are combined with the thrifty and maneuverability features of the present device.

The Murcott U.S. Pat. No. 3,203,008 describes a swingable seat structure for bathtubs such that a person can be positioned on the seat and then moved into a position over the bathtub for bathing. The structure can be adapted for use with tubs of different depths. The Hayden U.S. Pat. No. 3,022,518 describes a swivel chair for bathtubs whereby a person can sit on a chair at the edge of a tub and swing himself over the edge of the tub and into the tub while still seated.

SUMMARY OF THE INVENTION

The present invention relates to a chair for semi-impaired or semi-disabled people, to permit them to sit while taking a shower. The chair is held in place on supports that are adjustable to fit different bath tub widths, and support a seat that is mounted onto a seat adjustment unit, the seat adjustment unit permits fore and aft movement, as well as swiveling, so that it is easy to use and will permit people to adapt it to a wide range of bath tubs or shower stalls. Because the seat can be easily adjusted, it is easy to use and very safe. A backrest is provided, which will fold for storage. The unit is made to be rustproof. Suitable guide supports can be used in combination with the chair to aid people in getting into and out of the chair. Once in the chair, however, safety is insured, and adequate adjustment for insuring thorough showering is available.

DETAILED DESCRIPTION OF THE PREFERRED EMBODIMENTS

Figure 1:
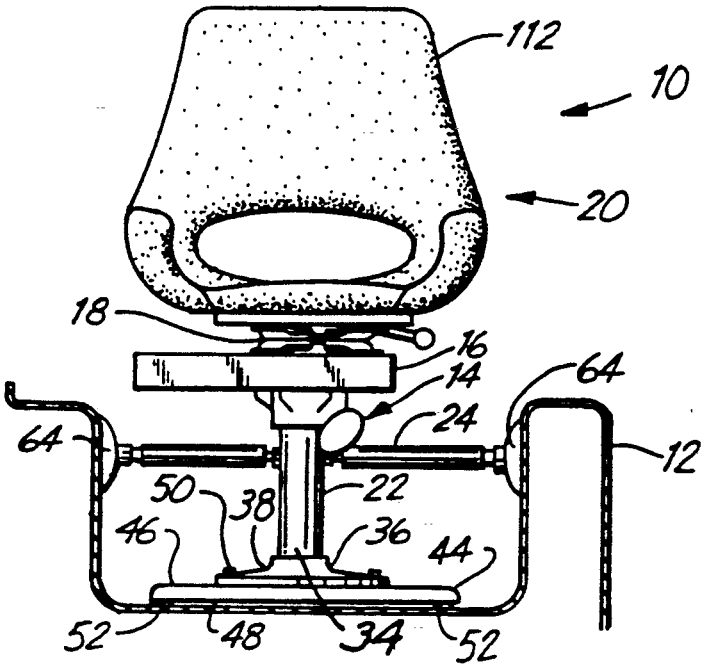
FIG. 1 is a front view of the shower chair made according to the present invention.
Figure 2:
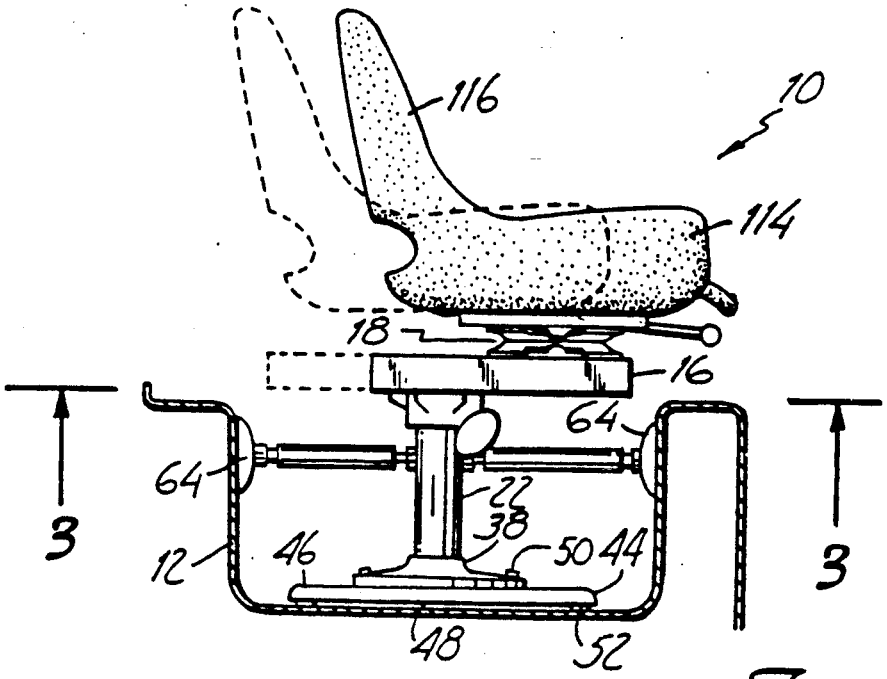
FIG. 2 is a side view thereof with an aft portion of the seat shown in phantom to illustrate the seat adjustment range.
Figure 3:
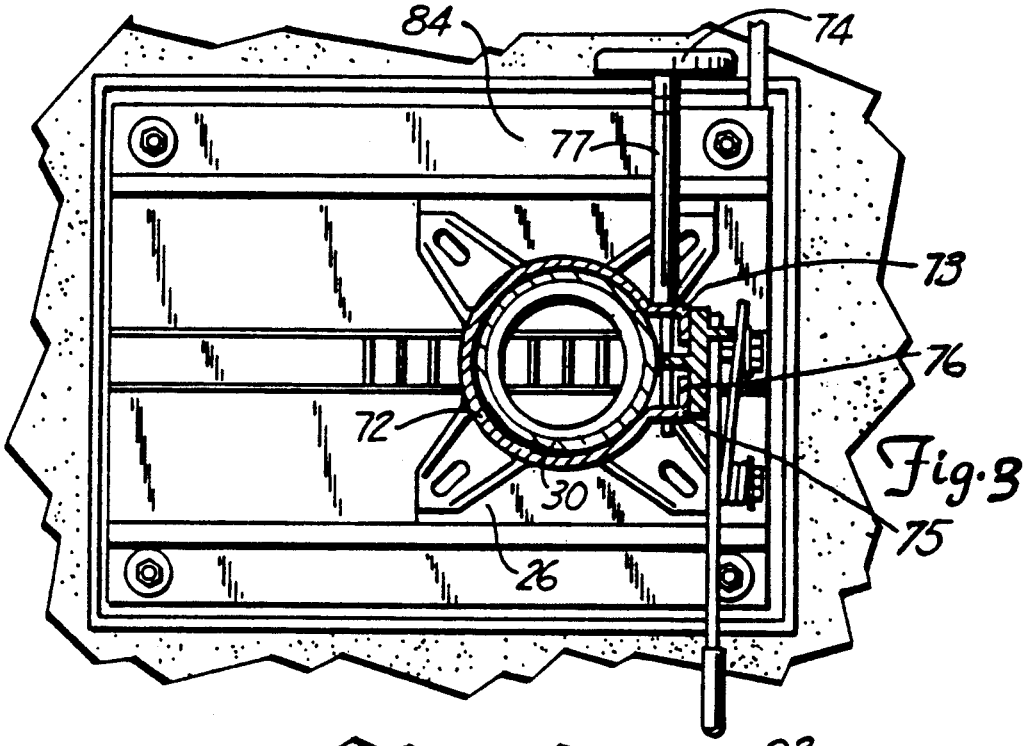
FIG. 3 is a bottom sectional view taken as on line 3—3 in FIG. 2.

A shower chair indicated generally at 10 is adapted to fit within a shower stall or into a bathtub 12 as shown in FIGS. 1 and 2. In addition, the shower chair of the present invention can also be adapted for use in an automobile. The shower chair 10 includes a main support frame 14, a glide assembly 16 for providing fore and aft movement of the shower chair, a swivel assembly 18 and a seat assembly 20.

Figure 4:
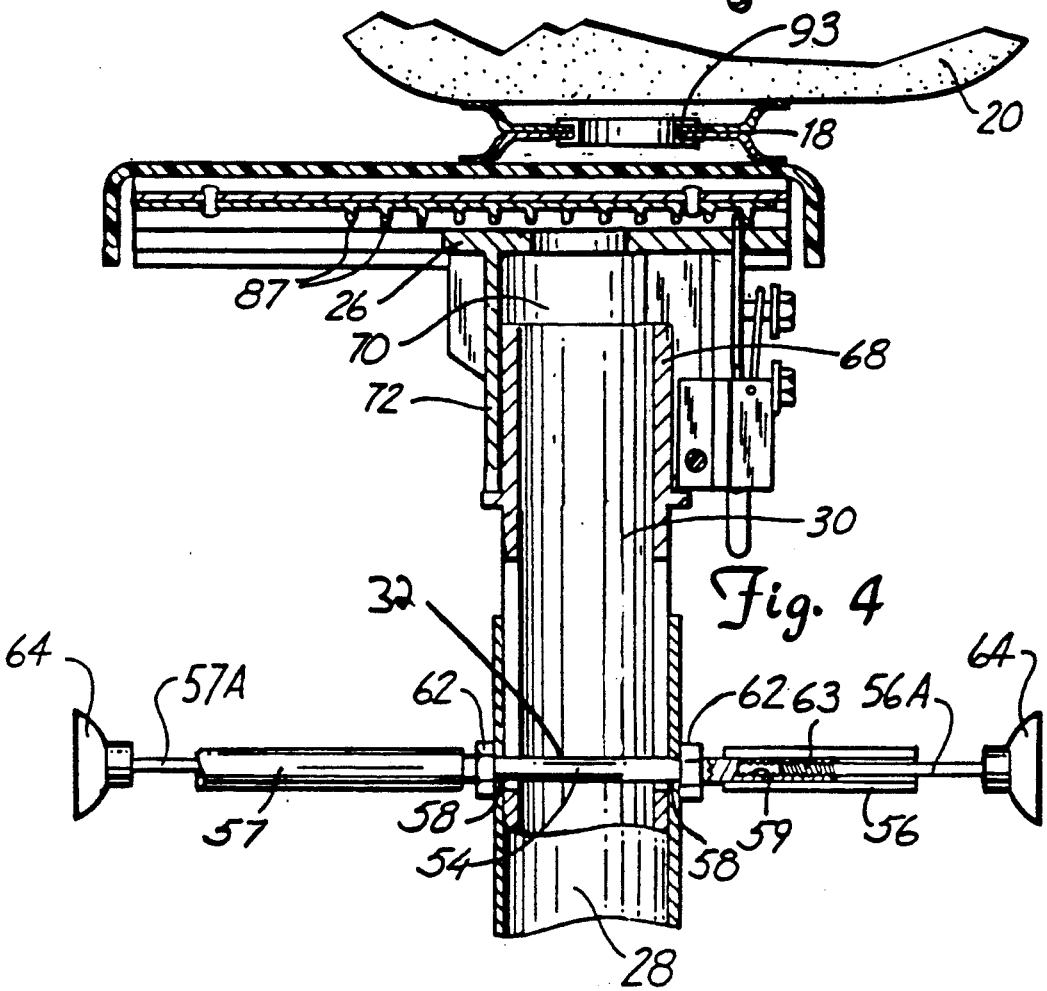
FIG. 4 is a side vertical sectional view.

As shown, the main support frame 14 comprises a center leg 22, a side or lateral leg assembly 24 that has portions extending through and outwardly on supported sides of leg 22 and a top support plate 26. The center leg 22 is preferably vertically adjustable, as illustrated in FIG. 4, by telescoping a lower leg section 28 relative to a top leg section 30 and having a suitable detente pin or other suitable safety device 32 for holding the first section 28 and the top section 30 together. By being able to vertically adjust the center leg 22, the shower chair 10 of the present invention is able to accommodate most depths of shower enclosures and bathtubs 12. It should also be noted that it is within the scope of this invention to have a center leg which is non-adjustable.

The lower end portion 34 of the center leg 22 rests on a pedestal 36. The pedestal 36 includes a collar 38 located in the substantial center of the pedestal 36. The collar 38 surrounds the lower end of the lower leg section 28 and the lower leg section is fixed to the collar 38 to securely hold the center leg 22 in upright position. In a preferred embodiment, the lower end of the lower leg section 28 is welded to the collar 38.

A base 44 having a first side 46 and a second side 48 is also provided. Preferably, the pedestal 36 is securely fastened to the first side 46 of the base 44 by a plurality of bolts 50 or the like. The base 44 has rubber bumpers 52 securely attached to the second side 48 and is positioned such that the rubber bumpers 52 rest on the floor of a shower enclosure or on the bottom of a bathtub 12. It should be noted that by equipping the base 44 with rubber bumpers 52, the shower chair 10 is completely portable and does not require that the shower enclosure or the bathtub 12 being used be modified or altered. In addition, the rubber bumpers 52 prevent the shower enclosure or the bathtub 12 from being scratched or damaged.

The lateral leg assembly 24 includes a threaded cross rod unitary member 54 having adjusting outer sleeves 56, 57 threaded thereon. The rod 54 extends through cross holes 58 in the center leg 22 perpendicular to the leg 28 longitudinal axis as best illustrated in FIGS. 1, 2 and 4.

The cross rod 54 is securely held to the center leg 22 by a plurality of nuts 62. The nuts 62 are threaded onto the cross rod 54 and tightened against the center leg 22. Preferably, the cross rod 54 has a diameter of approximately $\frac{3}{8}$ inch.

The lateral leg assembly 24 can be adjusted laterally by using adjusting sleeves 56, 57 rotatably mounted on the opposite ends of cross rod 54. The lateral leg assembly 24 includes a threaded bore or opening 59 on each side of the cross rod 54.

As illustrated in FIG. 4, the sleeves 56, 57 have separate short threaded rods 56A and 57A attached thereto. The threaded rods 56A and 57A have suction cups 64 fixed at their outer ends and a threaded portion 63 which threads into the threaded opening 59 for holding the cross rod 54 and the sleeves 56, 57 together. The suction cups 64 will stick firmly to the surface of a shower enclosure, or the side of a bathtub 12 when the sleeves 56, 57 are rotated to extend the threaded rod 56A and 57A outwardly to securely hold the main support frame 14 in place. The suction cups 64 can be released in a known manner as the sleeves 56, 57 are threaded inwardly.

The top support plate 26 is securely fastened to the top end portion 68 of the upper section 30 of center leg 22. The top support plate 26 mounts a split collar 72 defining an opening 70 located in the substantial center thereof. The collar 72 is designed such that the top end portion 68 closely fits within the opening 70 and the split collar can be clamped to hold the upper section 30 tightly.

A tightening knob 74 driving a tightening screw 76 is provided to clamp or secure the top support plate 26 to the upper section 30 and thus to the pedestal 36. The tightening screw 76 rotates in one wall 73 of a clamp flange and threads into the other wall 75 of the clamp flange. When the tightening screw 76 is tightened, a sleeve 77 on the screw 76 bears on the wall 73 and the walls 73 and 75 are clamped together to tighten the split collar 72 onto the upper section 30. The knob 74 is rotatable approximately one-half turn in each direction to either tighten or release the split collar 72 so the top support plate 26 will be held with respect to or permitted to rotate relative to the pedestal 36. As can be seen, the bottom of the split collar 72 is supported for rotation of the top support plate 26 on a flange on the upper leg section 30.

A glide assembly 78 is mounted relative to the main support frame 14 through the use of fore and aft extending adjusting members 80 such as tracks that mate with a guide members 82 on the edges of the top support plate 26. Preferably, the tracks 80 slide along the guide members 82 by means of ball bearings between the tracks 80 and the guide members 82 or as shown by means of a teflon coating disposed on the guide members 82.

The guide members 82 are fixed to the top support plate 26 and are spaced laterally apart along side edges of plate 26, and extend in fore and aft direction, that is along the direction substantially perpendicular to the longitudinal length of a bathtub 12. The tracks 80 are on a guide plate 83 which is connected to a seat support plate 84. The center portion of the seat support plate 84 has a row of receptacles formed between ribs 87 that act as retainers for a releasable latch dog 86 operated with a handle 88 pivotally attached to the collar 72 on top support plate 26 at 89 adjacent the split in the collar so that a person seated can move the handle 88 and release the latch dog 86 from one receptacle on the seat support plate 84 to permit the seat support plate 84 to be slid fore and aft to achieve a desired position even after the suction cups 64 have been fixed into place. When the handle 88 is pulled upward, the pivot point 89 slides downward in the split to release the latch dog 86. The latch dog 86 and the handle 88 are spring loaded to move the pivot point 89 upward in the split to a latched position with a torsion spring 91 when the handle 88 is released.

In the preferred embodiment, the glide assembly 78 has a fore and aft movement range of approximately five and one-half inches. This allows the seat assembly 20 to glide over the edge of the bathtub 12 such that a person who is either semi-impaired or semi-disabled to easily enter and exit the seat assembly 20 without having to step over the side of the bathtub 12.

The seat support plate 84 is provided to prevent water and other debris from entering the glide assembly 78. The seat support plate 84 is preferably in the form of an inverted pan which is attached to the glide assembly 16 in a known manner.

Additionally, a swivel assembly 90 comprising a first swiveling plate 92 and a second swiveling plate 94 is securely attached to the seat support plate 84. The two swivel plates 92 and 94 are rotatably fastened together with a swivel collar 93 in a conventional manner. The swivel assembly 90 can be utilized to permit the seat assembly 20 to swivel about an upright axis 96 so that a person taking a shower can make sure that all areas of the skin are subjected to the water being emitted from the shower head.

Figure 5:
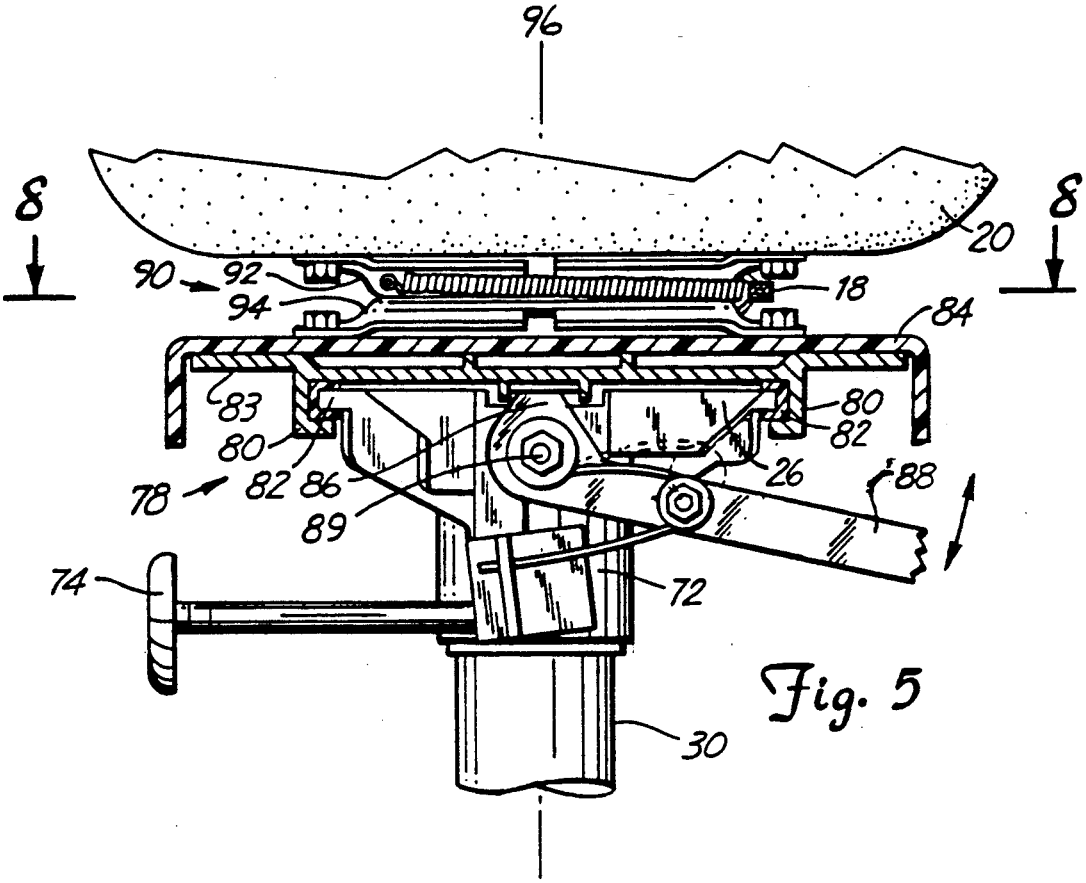
FIG. 5 is a fragmented side view of a shower chair made according to the present invention with portion in section and parts broken away.
Figure 6:
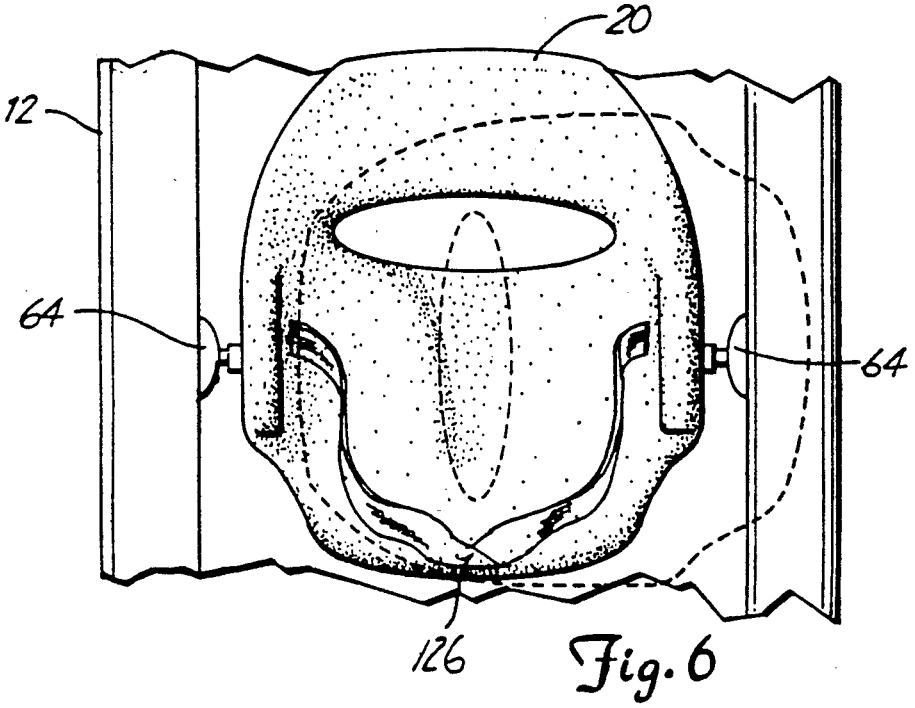
FIG. 6 is a top view of the chair showing in phantom the chair swiveled partially to the side for aid of entry.
Figure 7:
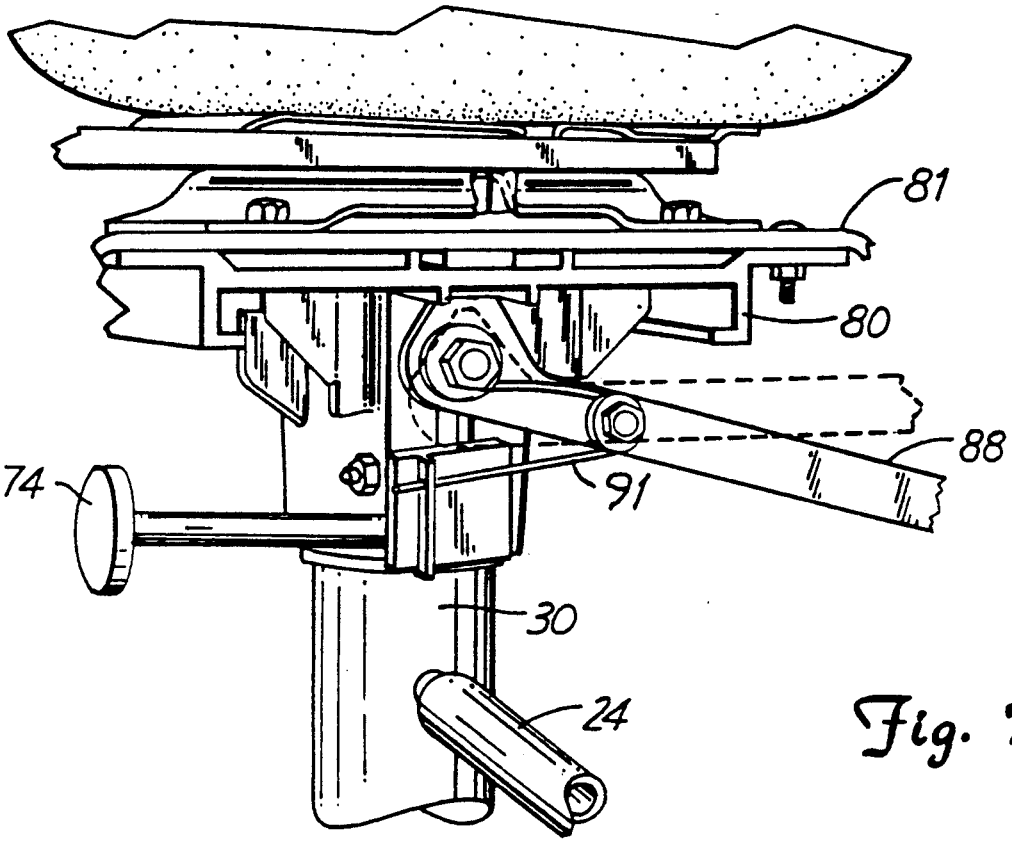
FIG. 7 is a fragmented side view showing in phantom the disengagement portion of the swivel lever.

The second swiveling plate 94 is securely attached to the seat support plate 84 by a plurality of bolts 98 or the like as best illustrated in FIG. 5. The first swiveling plate 92 is connected to the second swiveling plate 94 such that the first swiveling plate 92 can move freely, 360°, in relation to the second swiveling plate 94 about the central axis 96.

Figure 8:
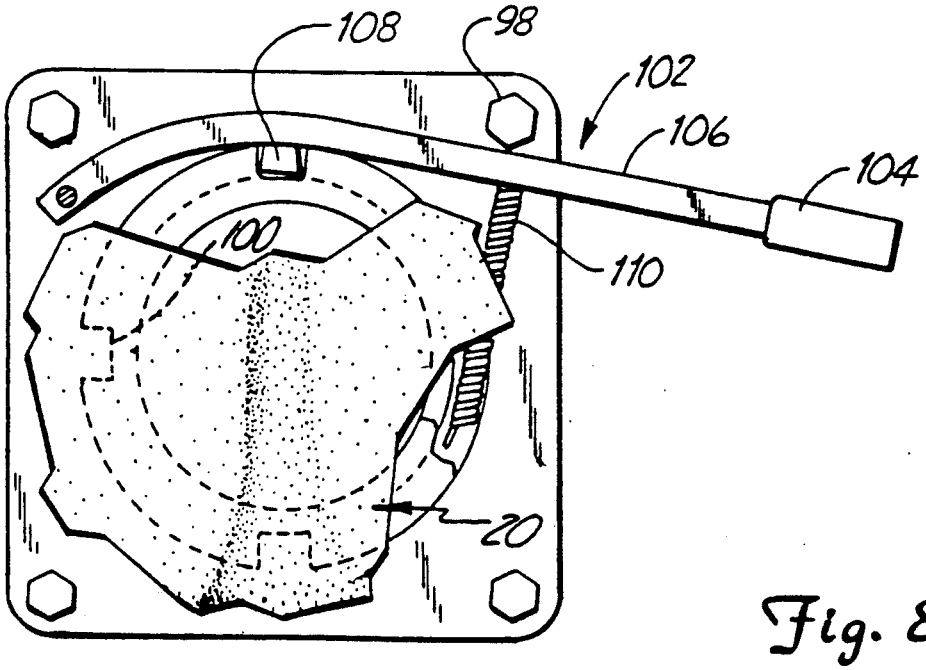
FIG. 8 is a top sectional view taken as on line 8—8 in FIG. 5.

As illustrated in FIG. 8, the first swivel plate 92 includes a plurality of notches 100. In the preferred embodiment, there are four notches 100 located equidistant from each other such that each opposite pair of notches 100 is situated either along the direction perpendicular to the longitudinal length of a shower enclosure or a bathtub 12 or along the direction parallel to the longitudinal length of a shower enclosure or a bathtub 12.

The swivel assembly 18 also includes a locking lever 102 having a handle portion 104, an arm portion 106 and a locking pawl 108. The lever 102 is pivotally fastened to the bottom of the seat assembly 20. The lever 102 is adapted to be located on either side of the seat assembly such that the handle portion 104 can be easily grasped depending on whether the user is left or the right handed.

A locking pawl 108 is securely attached to the arm portion 106 of the lever 102 and is adapted to engage the notches 100 of the first swivel plate 92. A spring 110 is attached to the arm portion 106 of the lever 102 in a known fashion to urge the lever 102 towards the first swivel plate 92 and, thus, to urge the locking pawl 108 into locking engagement with one of the notches 100.

To swivel the seat assembly 20, the lever 102 is moved to disengage the locking pawl 108 from the notch 100. The seat assembly 20 is then rotated in either direction. Upon reaching the desired position, either perpendicular or parallel to the longitudinal length of the shower enclosure or bathtub 12, the handle portion 104 is released and the spring 110 urges the lever 102 back towards the first swivel plate 92 such that the locking pawl 108 engages the notch 100.

The seat assembly 20 includes a seat 112 having a seat bottom and a seat back, both of which are made of a suitable plastic and can be molded in any desired manner. The seat assembly 20 is supported on and securely attached to the first swivel plate 92 in a suitable manner. The seat bottom has mounting ears at the rear portions thereof which receive tabs from the seat back, and using a pin provides for pivotally mounting the seat back such that the seat back 116 can be stopped in a desired position through the use of stop means at the rear of the seat bottom. The stop means can be adjustable if desired to change the angle of inclination of the seat back. In addition, the seat back 116 can be folded completely down to rest on the seat bottom to assist in the ease of transporting the shower chair 10. A non-adjustable seat back securely attached to the seat bottom is also within the scope of this invention.

The seat assembly 20 can be the type that is used at the present time for boats, and is not in and of itself new. The fore and aft adjustment can be any desired type, but greatly aids an efficient use of the assembly to properly position the person seated. The swivel assembly 90 also can be part of a boat seat assembly, which is commonly known.

The parts for the main support frame 14 can be made of plastic tubing, so that it is completely rustproof, and the glide assembly 78 and the pivot assembly 90 resists rust as well. The top support plate 26 and the seat support plate 84 for the seat 112 can be all plastic as can the seat 112.

The seat 112 can be covered with a suitable synthetic material cushion or pad if desired for greater comfort, and of course it should be one that will drip dry or rinse easily and will not be affected adversely by water. In addition, a seat belt 126 can be provided comprising a ¾" webbed belt with a hook and loop fastener sold under the mark Velcro fastener.

Although the present invention has been described with reference to preferred embodiments, workers skilled in the art will recognize that changes may be made in form and detail without departing from the spirit and scope of the invention.

What is claimed is:

1. A shower seat assembly comprising:

a main support assembly adapted to rest on the floor of a bathing compartment, the bathing compartment having side walls;

a seat mounted on the main support assembly;

adjustment means between the seat and the main support assembly comprising members to permit adjustment of the seat linearly in a direction substantially perpendicular to the side walls of the bathing compartment, and to permit swiveling movement of the seat about a generally upright axis of the seat by a person seated thereon;

locking means for releasably securing the seat relative to the main support assembly; and securing means to prevent sliding of the support relative to the surface on which it is supported, the securing means comprising suction cups adapted to engage an interior surface of the bathing compartment.

2. The apparatus as specified in claim 1 and further including handle means accessible by a person seated on the seat, the handle means being capable of releasing the locking means to thereby allow the seat to move linearly relative to the side walls of the bathing compartment.

3. The apparatus as specified in claim 1 wherein the support is adjustable in a vertical direction.

4. The apparatus as specified in claim 1 wherein the securing means comprises a pair of legs having lateral adjustment means to permit adjustment of the lateral width of the legs relative to the enclosure.

5. A shower seat assembly for use in a bathing compartment having side walls, comprising:

a main support assembly including a pair of legs having lateral adjustment means to permit adjustment of the lateral width of the legs relative to the enclosure, the main support assembly adapted to rest on a floor of the bathing compartment and being adjustable in a vertical direction;

a seat mounted on the main support assembly;

a glide assembly mounted between the seat and the main support assembly comprising an adjustable track to permit adjustment of the seat linearly in a direction substantially perpendicular to the side walls of the bathing compartment;

a swivel assembly to permit swiveling movement of the seat about a generally upright axis of the seat by a person seated thereon;

a locking assembly for releasably securing the seat relative to the main support assembly; and suction cups mounted on the legs to prevent sliding of the support relative to an interior surface of the bathing compartment.

* * * * *